US005664290A

United States Patent [19]

Scherrer

[11] Patent Number: 5,664,290

[45] Date of Patent: Sep. 9, 1997

[54] HINGE DEVICE FOR SWIVEL HOLDING OF A LEAF FLAP

[75] Inventor: Kurt Scherrer, Münsingen, Switzerland

[73] Assignee: USM U. Schaerer Sohne AG, Munsingen, Switzerland

[21] Appl. No.: 625,815

[22] Filed: Apr. 4, 1996

[30] Foreign Application Priority Data

Apr. 4, 1995 [CH] Switzerland ..... 953/95

[51] Int. Cl.[6] ..... E05D 15/32; E05F 1/08

[52] U.S. Cl. ..... 16/370; 16/287; 16/289; 312/319.2; 312/325

[58] Field of Search ..... 16/370, 366, 368, 16/369, 78, 72, 286–290; 49/386; 312/319.1, 319.2, 325

[56] References Cited

U.S. PATENT DOCUMENTS

| | | | |
|---|---|---|---|
| 683,887 | 10/1901 | Bedell | 16/289 |
| 1,303,697 | 5/1919 | McLaughlin | 312/319.2 |
| 1,403,037 | 1/1922 | Knechtel | 16/287 |
| 2,120,685 | 6/1938 | Soss | 16/288 |
| 2,520,921 | 9/1950 | Foster | 16/288 |
| 2,550,161 | 4/1951 | Pearce . | |
| 2,568,225 | 9/1951 | Doman . | |
| 4,076,351 | 2/1978 | Wyant | 312/319 |
| 4,853,985 | 8/1989 | Perry | 16/287 |
| 5,398,450 | 3/1995 | Cacicedo | 49/386 |

FOREIGN PATENT DOCUMENTS

| | | | |
|---|---|---|---|
| 0565809 | 10/1993 | European Pat. Off. . | |
| 9114348 | 1/1992 | Germany . | |
| 4023382 | 1/1992 | Germany | 49/386 |
| 291218 | 6/1928 | United Kingdom . | |
| 1090183 | 11/1967 | United Kingdom . | |

*Primary Examiner*—Chuck Y. Mah

*Attorney, Agent, or Firm*—Birch, Stewart, Kolasch & Birch, LLP

[57] ABSTRACT

Device for swivel holding of leaf flap which can swivel especially around a horizontal axis comprises a straight four-bar mechanism (8.1, 8.2, 10.1, 11.1) and elastic means (18) to damp the swivel motion. The elastic means have spring element (18) which is guided with its extensible part to move around anchoring element (7). Anchoring element (7) is for example a plastic ring which is inserted in hinged frame (1) of device. Its diameter corresponds to a multiple of a diameter of spring element (18). The entire device is preferably structured symmetrically with respect to the plane defined by the movement of four-bar mechanism (8.1, 9.1, 10.1, 11.1).

20 Claims, 3 Drawing Sheets

HINGE DEVICE FOR SWIVEL HOLDING OF A LEAF FLAP

TECHNICAL DOMAIN

The invention relates to a device for swivel holding of a leaf flap which can swivel especially around a horizontal axis, comprising a straight four-bar mechanism and elastic means to damp or balance the swivel motion. Furthermore, the invention relates to a cabinet which is guided by four-bar mechanisms and which is balanced preferably by elastic means.

BACKGROUND OF THE INVENTION

Guidance of tiltable window leaves and swivelling cabinet doors by a straight four-bar mechanism is known (compare for example DE-32 39 989 A1 or DE-27 45 934 A1). These structures make it possible to guide the leaf around imaginary geometrical axes and to raise the leaf before swivelling out of the frame in the desired manner.

Equipping four-bar mechanisms with springs in order to support the swivel motion is furthermore known from DE-32 39 989 A1.

SUMMARY OF THE INVENTION

The object of the invention is to devise a device of the initially mentioned type which is characterized by a compact construction.

According to the invention this object is achieved by the fact that in a device of the initially mentioned type the elastic means enclose a spring element which is guided with its extensible part to move around an anchoring element.

The advantage of this design is that there is nowhere to place an element with suitable force evolution. It must be possible to push the spring element around the anchoring element in order that it can uniformly stretch over its entire length as it is loaded.

Preferably the spring element is a helical spring which can be tension-loaded. In principle, a rubber element is also conceivable.

The anchoring element forms an arc-shaped guide with a radius of curvature which corresponds to a multiple of half the diameter of the spring element. The spring element therefore undergoes relatively mild bending. The radius of curvature of the guide is for example at least three times larger than half the diameter of the guided helical spring. At very small radii of curvature, the load and danger of breakage of the spring element increase in undue proportion.

The spring element is preferably attached by both ends to the four-bar mechanism. That is, the spring is more strongly stretched than the displacement path of the corresponding point of application. If the two ends act at the same point of the four-bar mechanism the longitudinal extension is twice the path traversed by the point of application. But it is also possible to have the two ends of the spring act at two different points of the four-bar mechanism. Depending on the desired force evolution, one end of the spring can also be anchored to an immovable point. The device can be designed such that the user himself has the opportunity to adjust the spring tension by selecting the points of application which are suitable for his use.

The four-bar mechanism is preferably supported to move on a hinged frame on which the anchoring element is also formed. That is, the four-bar mechanism, hinged frame and anchoring element form a structural unit which can be installed as a whole.

To better stabilize the four-bar mechanism, the hinged frame supports the four-bar mechanism essentially symmetrically with reference to one plane of movement of the latter. In this way undesirable torques in the four-bar mechanism and the bearing of the four-bar mechanism can be minimized. The symmetrical support is also suitable for devices without elastic means for damping the swivel motion.

It is also especially advantageous if the four-bar mechanism can be lowered entirely in the hinged frame. The hinged frame can be open or closed in doing so. This capacity to be lowered has the advantage of reducing the danger of objects entering the path of movement of the four-bar mechanism or of individuals injuring themselves when the leaf flap is unintentionally actuated.

The capacity to be lowered can be especially easily combined with the symmetrical structure of the hinged frame. In any case the lowerable structure is not limited to swivel devices with spring elements.

Lowerable or symmetrical structures can also be made with different spring elements. In particular, they can be combined with the usually linearly guided helical springs. Both in the lowerable and in the symmetrical structure the spring element is preferably integrated in the hinged frame. It is executed for example such that it withdraws the four-bar mechanism into the hinged frame in order to be tensioned when the leaf flap is opened.

In linearly formed spring elements, compression spring structures can also be easily used which press the four-bar mechanism out of the hinged frame, for example in order to be tensioned when the leaf flap is closed.

According to one embodiment which can be produced especially cost-favorably, the hinged frame is essentially made from two frame parts which are formed of sheet metal and which are joined to one another (for example, riveted) at a specific distance. The hinged frame is for example, oblong, in which on one end there is the (end) opening by which the four-bar mechanism or one part thereof can be moved out. On the other end is the preferably annular anchor for the spring element. For this reason for example a plastic ring can be inserted between the frame parts, with an axis which is perpendicular to the plane of movement of the four-bar mechanism.

Preferably the four-bar mechanism is formed by two arms which are swivel-attached to the hinged frame and two arms which are attached parallel to one another to the indicated arms. For example one attachment arm which can be joined to the leaf flap is hinged to the latter arms.

For the purposes of the preferred symmetrical version the arms mentioned first are executed as double arms which each hold the arms mentioned second, in the manner of a fork. A symmetrical structure can also be implemented by the fact that the second-named arms which hold the attachment arm are each made double and thus fit around the first-named arms on both sides.

To balance the inherent weight of the flap guided with a device according to the invention, there can be two springs which act at the points of application of different lever action on the four-bar mechanism. Depending on the length of the lever arm assigned to the spring force, a more or less strong "counterweight" acts on the flap. Preferably, the rotary element is a lever with adjustable length of the effective lever arm. Instead of a lever, there can be an eccentrically supported roller with springs attached to its periphery and with the springs partially resting or being guided on its periphery.

Swivel devices according to the invention are used to special advantage for cabinets which have a leaf flap which can swivel around a horizontal axis. One typical application is hinged cabinets with doors which are folded down from a vertical into a horizontal position when opened. By means of suitable dimensioning of the springs, the door can be largely balanced so that it can be easily opened and closed. The advantage of the spring-damped construction according to the invention consists in that the force evolution increases with increasing opening angle and thus compensates for the increasing torque which is caused by the weight of the door. In this regard the device according to the invention is clearly superior to the known constructions with gas pressure cylinders.

The frame opening for the leaf doors is formed for example by pipes. With the swivel device according to the invention the leaf flap can be swivelled around the geometrical axis of one of the frame pipes.

It is especially advantageous to make the leaf flap double-walled and to provide it with recesses for hanging the attachment arms. This facilitates installation of the swivel device and the leaf flap. The swivel devices are attached to the side wall of the cabinet, after which the cabinet door is pushed onto the attachment arms and is screwed to them.

Other advantageous embodiments and combinations of features stem from the following detailed description and the totality of the patent claims.

BRIEF DESCRIPTION OF THE DRAWINGS

The drawings used to explain the embodiments show the following.

Basically the same parts are labeled with the same reference numbers in the Figures.

DETAILED DESCRIPTION OF THE INVENTION

Figure 1A:
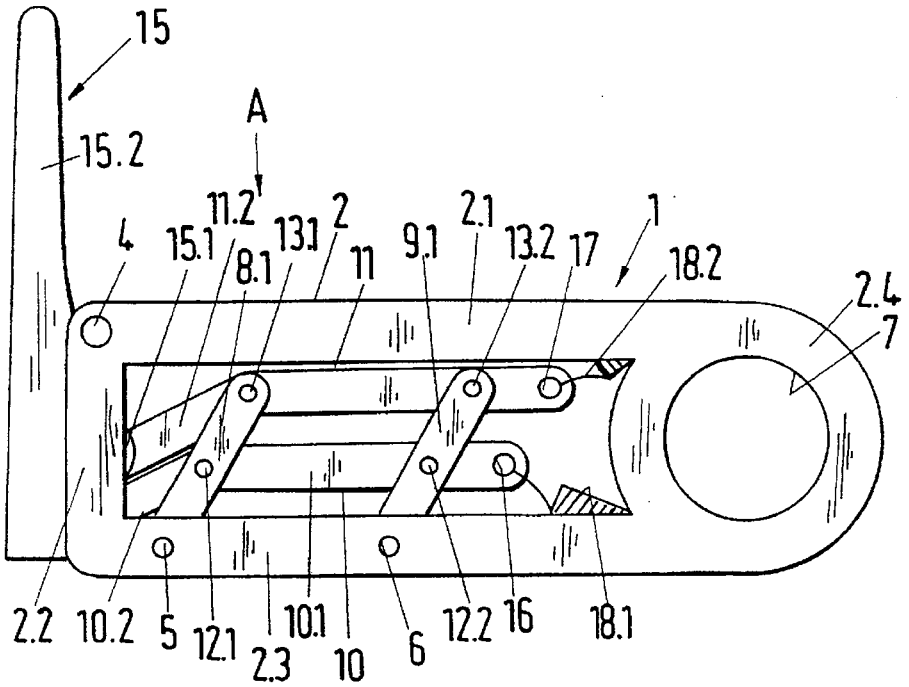
FIGS. 1*a*, 1*b* show one side view of a scissors pair according to the invention in the closed and open position.
Figure 1B:
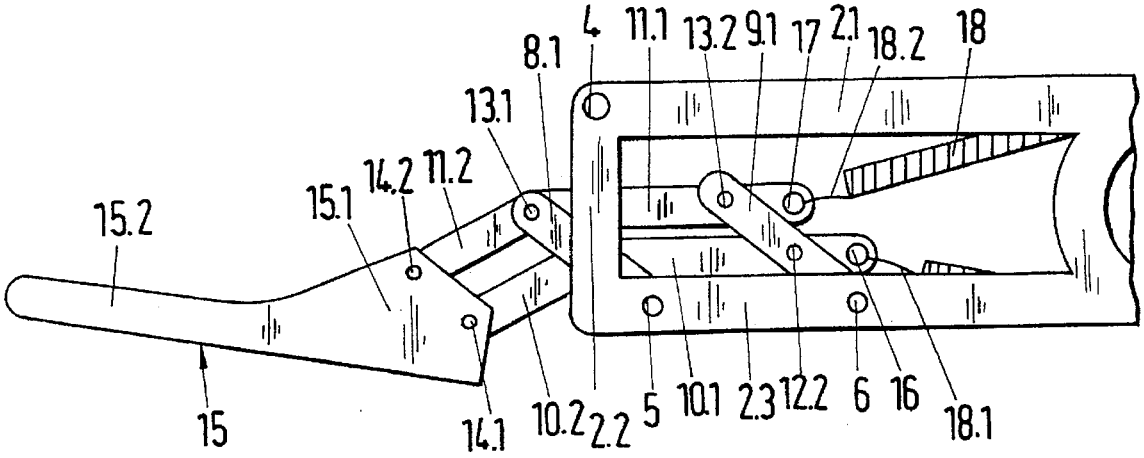
Figure 2:
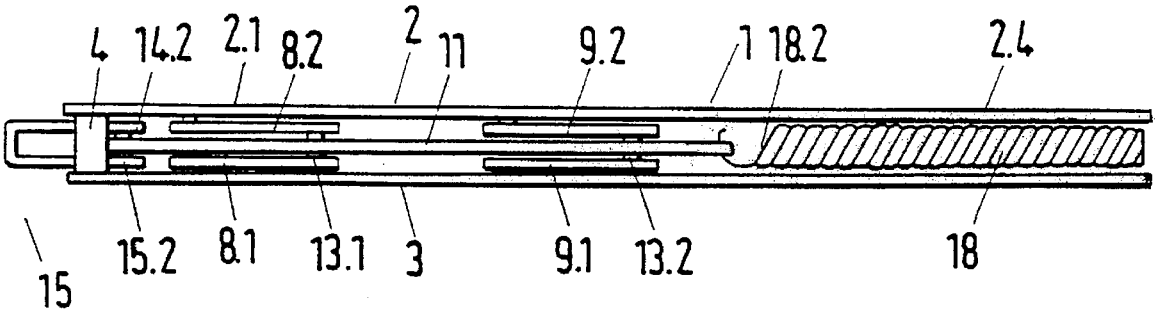
FIG. 2 shows an overhead view according to view A from FIG. 1*a;*

The device shown in FIGS. 1*a*, 1*b*, and 2 has hinged frame 1 which is formed from two parallel sheet metal frames 2, 3 (compare FIG. 2). Two sheet metal frames 2 and 3 are congruent. In the following therefore only one is detailed.

Sheet metal frame 2 is oblong and has a rectangular or U-shaped part which is formed by three strip-like frame sections 2.1, 2.2, 2.3, and annular frame section 2.4 on the back end of hinged frame 1. Since the four-bar mechanism described below is visible from the outside, it is a so-called open hinged frame. In a so-called closed version, the sheet metal frames would be replaced by sheet metal plates.

Two parallel sheet metal frames 2, 3 are joined by three riveted joints 4, 5, 6 in a rectangular part and by plastic ring 7 in annular frame section 2, 4 and are kept parallel at a specific distance. As follows from the description below, another second function is assigned to each of riveted joints 4, 5, 6 and the plastic ring, in addition to the connection function.

Riveted joints 5, 6 formed as continuous axes are used at the same time as axes of attachment and rotation of turning arms 8.1, 8.2 and 9.1., 9.2, respectively. All four turning arms 8.1, 8.2, 9.1, 9.2 move parallel to one another. With the scissors pair retracted (as is shown in FIG. 1*a*) turning arms 8.1, 8.2, 9.1, 9.2 are sloped obliquely to the rear against frame section 2.4 (for example, at a 60° angle with respect to strip-shaped frame section 2.3).

Angle arm 11 with pins 13.1, 13.2 is articulated to the (swiveling) end of turning arms 8.1, 8.2, 9.1, 9.2. Angle arm 11 has one long and one short section 11.1 and 11.2, respectively. Long section 11.1 is guided by turning arms 8.1, 8.2, 9.1, 9.2 parallel to frame sections 2.1. and 2.3. Short section 11.2 with long section 11.1 forms an angle of for example roughly 150°.

A second identical angle arm 10 (with two analogous sections 10.1, 10.2) is joined to turning arms 8.1, 8.2, 9.1, 9.2 by pins 12.1, 12.2. Pins 12.1, 12.2 are each located roughly in the center between riveted joint 5 and 6, respectively and pin 13.1 and 13.2, respectively. Turning arms 8.1, 8.2, 9.1, 9.2 with angle arms 10, 11 (especially with sections 10.1, 11.1) form a hinged parallelogram.

On the front ends of small Dent sections 10.2, 11.2 swivel arm 15 is swivel-held by pin 14.1 and 14.2, respectively. Swivel arm 15 is U-shaped in cross section. At the same time it has (in a side view) widened base section 15.1 and narrow finger-shaped end section 15.2. The widening in base section 15.1 is configured such that the connecting line between two pins 14.1, 14.2 and the longitudinal axis of end section 15.2 are at a certain angle of for example 30° to one another. The size of the angle stems from the fact that in the withdrawn state according to FIG. 1*a* turning arms 8.1, 9.1 are at an angle not equal to 90° with reference to the connecting line of riveted joints 5 and 6. With the scissors pair retracted, in this case the longitudinal axis of end section 15.2 is perpendicular to the indicated connecting line of riveted joints 5, 6, but not parallel to turning arms 8.1, 8.2, 9.1, 9.2.

On the back ends of angle arms 10, 11 hooks or eyes 16 and 17, respectively are formed. Two ends 18.1, 18.2 of tension spring 18 can be hooked or attached to them. Tension spring 18 according to the invention is guided around plastic ring 7. The diameter of plastic ring 7 is for example three to four times as large as the diameter of tension spring 18.

The scissors pair is structured to be entirely symmetrical with reference to the plane of motion of the hinged parallelogram (i.e., symmetrical with respect to the plane of the drawing according to FIG. 1*a, b*). This is especially apparent from FIG. 2. Angle arms 10, 11 are located in the plane of symmetry. They are flanked by double arms 8.1/8.2 and 9.1/9.2. Swivel arm 15 which is U-shaped in cross section encompasses the front ends of angle arms 10, 11 from both sides with its base section 15.1. Tension spring 18 is located like angle arms 10, 11 in the plane of symmetry. The whole is surrounded by two identical sheet metal frames 2, 3.

In the following the manner of operation will be briefly explained using FIGS. 1*a*, 1*b*.

With the cabinet door closed the scissors pair is in the position shown in FIG. 1*a*. Swivel arm 15 then sits with its inner edge on riveted joint 4; this leads to accurate definition of the swivel arm position. The cabinet door attached to swivel 5 arm 15 is therefore kept in a specific closed position by the scissors pair itself. Stops provided in some other way do not matter.

When the cabinet door is opened, swivel arm 15 is swivelled or drawn to the outside against the force of tension spring 18. The hinged parallelogram here dictates on which path of motion swivel arm 15 is guided to the outside (into the position shown in FIG. 1*b*). If swivel arm 15 is moved into the horizontal position, sections 10.1, 11.1 of angle arms 10, 11 lie on top of one another and block further movement. The width and the distance of sections 10.1, 11.1 between one another are therefore intentionally selected such that they block the scissors pair in the swivelled-out position. If the folding door is loaded in the opened (usually horizontal) state, the scissors pair cannot be damaged.

When the scissors pair is opened tension spring 18 is expanded according to the paths traversed by the back ends of angle arms 10, 11 (i.e., eyes 16, 17). Since tension spring 18 can be moved with respect to plastic ring 7, the longitudinal extension can be distributed over the entire length of tension spring 18 without problems. Since the spring force of a helical spring increases as is recognized in proportion to its longitudinal stretching, the resetting torque which acts on swivel arm 15 is intensified the more so, the stronger swivel arm 15 is moved into the horizontal. This is an entirely desirable effect since the torque (which is caused by the inherent weight of the cabinet door) becomes likewise stronger, the more the cabinet door turns from the vertical into the horizontal.

Figure 3:
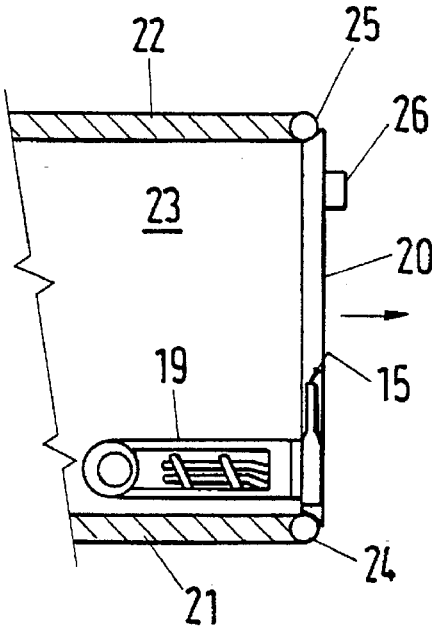
FIG. 3 shows a schematic representation of a cross section of a cabinet with a scissors pair according to FIGS. 1*a, b* and 2.

FIG. 3 illustrates a cabinet which is equipped with scissors pair 19 according to the invention. FIG. 3 shows a vertical cross section. I.e., bottom 21, cover 22 and cabinet door 20 are shown in cross section. Only one side wall 23 can be seen from the two side walls. (The rear wall is not shown). The cabinet opening is limited by pipes 24, 25. They form the edge skeleton of the typically cuboidal cabinet.

Scissors pair 19 is screwed to side wall 23 in its front bottom area. Swivel arm 15 fits into a recess or depression of cabinet door 20. If cabinet door 20 is for example made double-walled, end section 15.2 is dimensioned such that it finds space between the two walls of cabinet door 20. In the upper area cabinet door 20 has handle 26 for opening the cabinet.

Based on the specific geometrical dimensioning of scissors pair 19, cabinet door 20 is swivelled around the longitudinal axis of lower pipe 24 during opening. This geometrical swivel axis lies both outside cabinet door 20 and also outside of scissors pair 19.

It goes without saying that cabinet door 20 is held on both sides by a scissors pair. Based on the symmetrical design of the scissor pair it does not depend on whether the left-hand or the right-hand side of the cabinet door is mounted. This is a simplification not only for installation, but also for all storage and logistics of furniture suppliers.

The invention can be varied in diverse ways. Instead of a hinged parallelogram, for example, a four-bar mechanism can be used. Then for example one turning arm pair 8.1/8.2 can be used only to support lower angle arm 10. Pin 13.1 is not used so that angle arm 11 is joined only to turning arm 9.1 or 9.2 and swivel arm 15 and therefore need not be guided parallel to angle arm 10. In the same sense for example pins 12.1 or 12.2 can be abandoned. For a four-bar mechanism, generally swivel arm 15 can be swivelled 90° without turning arms 8.1, 8.2 and 9.1, 9.2 having to be likewise necessarily turned by 90°.

Instead of turning arm pair 8.1/8.2 and 9.1/9.2 fork-shaped single-piece turning arms can be used. That is, two turning arms 8.1, 8.2 are replaced by a single slotted turning arm, in which in the slot of the turning arm the angle arm can be pivotally attached.

Nor is the symmetrical structure essential. For example, one of the two sheet metal frames can be omitted so that the four-bar mechanism is still only supported on one side.

Nor is it essential that tension spring 18 be attached by both ends to one end of the angle arm at a time. End 18.1 can for example also be hung in eye 17. Then the reset force develops more strongly per angular rotation of swivel arm 15. Conversely the progression of the resetting torque can be reduced by hanging both ends 18.1, 18.2 in eye 16 (which traverses a smaller part of the path). It is furthermore conceivable that the hinged frame has pegs or hooks in order to anchor one of two ends 18.1, 18.2 stationary. All this results in the fact that it is easily possible to implement different reset moments with the same frame and scissors pair construction. This is advantageous if the scissors pairs are to be used for cabinet doors of different weights.

Figure 4:
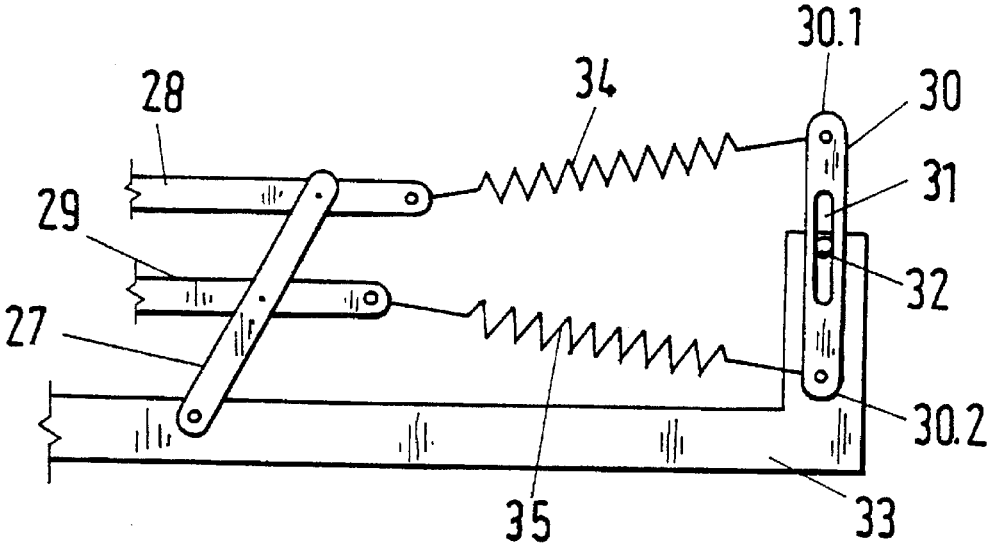
FIG. 4 shows a schematic of a device for adjustable balancing of a cabinet flap guided with a four-bar mechanism.

FIG. 4 shows one embodiment for adjustable balancing of a tiltable leaf. Turning arm 27 with two guide arms 28, 29 which are articulated to it is shown. Turning arm 27 and guide arms 28, 29 are parts of a (not shown completely) four-bar mechanism in the sense of FIGS. 1*a*, 1*b*. Lever 30 is pivotally attached to frame 33 (only partially shown). Rotary attachment 32 is located at a certain distance behind turning arm 27. The back end of guide arm 28 is joined by spring 34 to first end 30.1 and guide arm 29 is joined via second spring 35 to second end 30.2 of lever 30 of the first class.

If turning arm 27 is moved forward, springs 34, 35 are tensioned. The tension in the springs depends on the path traversed by guide arms 28, 29 and on the lever ratios in ends 30.1, 30.2 of lever 30. The rotary motion of lever 30 depends on the dimension of the system. It is important that springs 34, 35 act at different points of application of the four-bar mechanism.

Lever 30 has for example elongated hole 31 in its center area. Depending on at what distance rotary attachment 32 is located in elongated hole 31 with respect to ends 30.1 or 30.2, different lever ratios are accomplished. Accordingly, the reset force pressing on the four-bar mechanism can be set according to existing requirements.

Figure 5:
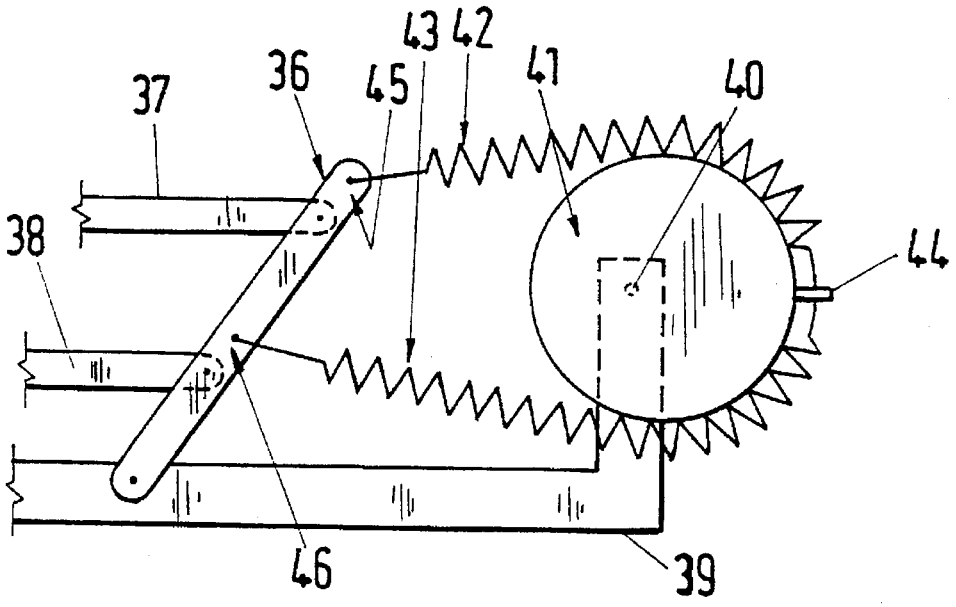
FIG. 5 shows a schematic of a device for adjustable balancing of a swivelling flap using an eccentrically supported roller.

FIG. 5 shows another version of a resetting spring mechanism. In turn, turning arm 36 is articulated to frame 39. Two guide arms 37, 38 are attached to turning arm 36 to form a four-bar mechanism of any type.

At a distance to turning arm 36 roller 41 is pivotally attached to frame 39. Pivot 40 of roller 41 is eccentric in this example. Attachment means 44 is attached to the periphery of roller 41 for first and second spring 42 and 43, respectively. Springs 42, 43 are guided along the periphery of the roller partially around it. The ends of springs 42, 43 are attached to turning arm 36 at suitably selected points of application 45, 46. Points of application 45, 46 have different distances to the pivot of turning arm 36.

When turning arm 36 (when the guided wing door is opened) is moved away forward from pivot 40, springs 42, 43 are tensioned. Since points of application 45, 46 traverse different paths and roller 41 are eccentrically supported, springs 42, 43 stretch to different degrees. Roller 41 will turn, for example, (in the representation according to FIG. 5) counterclockwise. Due to the eccentric support the torque exerted by spring 42 on roller 41 in this example becomes appreciably greater (because the distance of the release point of spring 42 from the periphery of roller 41 moves away from pivot 40), while the torque of spring 43 becomes smaller.

It is evident that by suitable selection of pivot 40 of roller 41 the reset force exerted on turning arm 36 can be varied.

The features explained using FIGS. 4 and 5 can in principle also be used independently of the other embodiments of the invention. They can also be combined in different ways with the other features of the invention.

Furthermore, it is also possible to abandon guidance of tension spring 18 around plastic ring 7. The back end of hinged frame 1 can for example offer fixed anchors so that one or more springs can be anchored to the four-bar mechanism and can act on it. If for example a tension spring is tensioned between riveted joint 4 and pin 13, a force which opens the scissors pair takes effect. This can be a good idea for example for a cover which is folded up for opening (as in a chest). Spring and other damping elements can of course also be abandoned.

In summary it can be maintained that by means of the invention an extremely compact and elegant device for holding or swivelling of cabinet, window or other leaves or flaps has been devised. The device is at the same time extremely durable and can be executed in the corresponding design.

I claim:

1. A device for swivel-holding of a leaf flap, comprising a generally planar-shaped frame having a pair of opposite front and back ends, a straight four-bar mechanism including at least two turning arms, each of said at least two turning arms having a first end portion and a second, swiveling end portion, said first end portions being rotably connected to the frame at a first side thereof, and at least two angle arms, one of said at least two angle arms being articulated to each of said second, swiveling end portions, the other angle arm being articulated to each of said at least two turning arms, said at least two turning arms and said at least two angle arms forming a hinged parallelogram, a swivel arm for swivel-holding of the flap, said swivel arm being connected with a front end of each of the angle arms to perform a rotation about an axis substantially perpendicular to the planar-shaped frame between an open position and a closed position, an elastic means for damping or balancing the swivel motion of the leaf flap, the elastic means having two ends, and an anchoring element disposed at the back end of the frame, wherein the elastic means is connected by said two ends to the four-bar mechanism and guided around the anchoring element.

2. The device according to claim 1, wherein the elastic means is a helical spring.

3. The device according to claim 2, wherein the anchoring element has an arc-shaped surface around which the elastic means is guided, said surface having a radius of curvature corresponding to a multiple of half the diameter of the helix of the helical spring.

4. The device according to claim 1, wherein the frame is symmetrical with reference to a geometric plane of movement of the four-bar mechanism and supports the four-bar mechanism essentially symmetrically.

5. The device according to claim 4, wherein the anchoring element is a ring with an axis which is perpendicular to the plane of motion of the four-bar mechanism.

6. The device according to claim 5, wherein the ring is a plastic ring.

7. The device according to claim 4, wherein each of the at least two angle arms has a first part and a second part, the first parts of each of the at least two angle arms being substantially parallel to one another.

8. The device according to claim 7, wherein each of the at least two turning arms is a double arm and the at least two angle arms are disposed in a fork-like manner between the double arm of each of the at least two turning arms.

9. The device according to claim 1, wherein the hinged parallelogram is extendable between a maximum extended position and a non-extended position and when in said non-extended position lies completely within the structural limits of the frame.

10. The device according to claim 1, wherein said swivel arm for attaching to the leaf flap is pivoted on the four-bar mechanism.

11. The device according to claim 1, wherein the elastic means is a spring element which withdraws the four-bar mechanism into the frame and is tensioned when said swivel arm is in the open position.

12. The device according to claim 1, wherein the elastic means is a spring element which is housed essentially completely within the structural limits of the frame (1).

13. The device according to claim 1, wherein the frame is essentially formed by two frame parts which consists of sheet metal and which are joined to one another at a predetermined distance.

14. A cabinet with a swiveling door, wherein the door is guided and held by two devices, each of said two devices comprising:

a generally planar-shaped frame having a pair of opposite front and back ends, a straight four-bar mechanism including at least two turning arms, each of said at least two turning arms having a first end portion and a second, swiveling end portion, said first end portions being rotably connected to the frame at a first side thereof, and at least two angle arms, one of said at least two angle arms being articulated to each of said second, swiveling end portions, the other angle arm being articulated to each of said at least two turning arms, said at least two turning arms and said at least two angle arms forming a hinged parallelogram, a swivel arm for swivel-holding of the flap, said swivel arm being connected with a front end of each of the angle arms to perform a rotation about an axis substantially perpendicular to the planar-shaped frame between an open position and a closed position, an elastic means for damping or balancing the swivel motion of the leaf flap, the elastic means having two ends, and an anchoring element disposed at the back end of the frame, wherein the elastic means is connected by said two ends to the four-bar mechanism and guided around the anchoring element.

15. The cabinet according to claim 14, wherein a framed opening closed by the door is bounded at least on one side by a pipe-shaped rod, and the door is swivelable around the geometric axis of said at least one rod.

16. The cabinet according to claim 14, wherein the door has a side end portion, said side end portion having a surface in which is disposed a recess for accommodating and affixing at least one of said swivel arm.

17. A device for swivel-holding of a leaf flap, comprising a generally planar-shaped frame having a pair of opposite front and back ends, a straight four-bar mechanism including at least two turning arms, each of said at least two turning arms having a first end portion and a second, swiveling end portion, said first end portions being rotably connected to the frame at a first side thereof, and at least two angle arms, one of said at least two angle arms being articulated to each of said second, swiveling end portions, the other angle arm being articulated to each of said at least two turning arms, said at least two turning arms and said at least two angle arms forming a hinged parallelogram, a swivel arm for swivel-holding of the flap, said swivel arm being connected with a front end of each of the angle arms to perform a rotation about an axis substantially perpendicular to the planar-shaped frame between an open position and a closed position, an elastic means for damping or balancing the swivel motion of the leaf flap, the elastic means having two ends, and a turning element disposed at the back end of the frame, wherein the elastic means connectably extends between the four-bar mechanism and the turning element.

18. The device according to claim 17, wherein the four-bar mechanism has a plurality of attachment points, and the elastic means includes two springs, said two springs being attachable to said plurality of attachment points such that a plurality of different lever actions may be applied on the four-bar mechanism.

19. The device according to claim 18, wherein each of the two springs is attached to the turning element with adjustable lever ratios.

20. The device according to claim 19, wherein the turning element is a lever with adjustable length of lever arms.

* * * * *